US010946404B2

(12) United States Patent
Tarantini

(10) Patent No.: US 10,946,404 B2
(45) Date of Patent: Mar. 16, 2021

(54) CLEANING-FILLING STATION FOR MEANS FOR SPRAYING A COATING PRODUCT

(75) Inventor: Joseph Tarantini, La Terrasse (FR)

(73) Assignee: SAMES KREMLIN, Meylan (FR)

( * ) Notice: Subject to any disclaimer, the term of this patent is extended or adjusted under 35 U.S.C. 154(b) by 477 days.

(21) Appl. No.: 14/129,859

(22) PCT Filed: Jul. 5, 2012

(86) PCT No.: PCT/EP2012/063174

§ 371 (c)(1),
(2), (4) Date: Dec. 27, 2013

(87) PCT Pub. No.: WO2013/004792

PCT Pub. Date: Jan. 10, 2013

(65) Prior Publication Data

US 2014/0144545 A1 May 29, 2014

(30) Foreign Application Priority Data

Jul. 6, 2011 (FR) ..... 1156106

(51) Int. Cl.
*B05B 15/55* (2018.01)
*B05B 12/14* (2006.01)
*B05B 13/04* (2006.01)

(52) U.S. Cl.
CPC ..... *B05B 15/55* (2018.02); *B05B 12/14* (2013.01); *B05B 13/0431* (2013.01); *B05B 13/0452* (2013.01)

(58) Field of Classification Search
CPC ... B05B 15/025; B05B 12/14; B05B 13/0431; B05B 13/0452; B05B 15/55; B05B 13/02; B05B 13/04

(Continued)

(56) References Cited

U.S. PATENT DOCUMENTS 1,950,852 A * 3/1934 Kuehn ..... F16C 33/74 277/372
2,560,557 A * 7/1951 Curtis ..... F16J 15/36 277/362

(Continued)

FOREIGN PATENT DOCUMENTS

EP 0274322 7/1988
EP 1207964 5/2002

(Continued)

*Primary Examiner* — Timothy L Maust
*Assistant Examiner* — James R Hakomaki
(74) *Attorney, Agent, or Firm* — Pearne & Gordon LLP

(57) ABSTRACT

A cleaning and/or filling station (10) of a subassembly for spraying a coating product mounted on a moving arm of a robot having a receiving zone (Z120) for receiving at least one sprayer belonging to the spraying subassembly and a connection device between at least one feed circuit and the sprayer in place in the receiving zone. The connection device has at least one part (131) movable between a retracted position, at a distance from the sprayer, and an active position, where the connection device enables the sprayer to be fed with cleaning product and/or coating product. The station has a flexible membrane (150) firmly attached, on the one hand, to the moveable part (131) and, on the other hand, to a fixed envelope (112) for protecting a portion of the connection device, while this membrane is deformable and suitable for following the displacements of the moveable part (131) between the retracted and active positions thereof.

12 Claims, 7 Drawing Sheets

(58) Field of Classification Search
USPC ..... 141/92, 91, 90, 2; 239/1, 390, 305; 118/323
See application file for complete search history.

(56) References Cited

U.S. PATENT DOCUMENTS 2,983,480 A * 5/1961 Greelie ..... B05C 5/0225 251/335.1
3,669,459 A * 6/1972 Bass ..... B23H 11/00 277/504
3,707,852 A * 1/1973 Burckhardt ..... F16J 15/52 277/634
4,190,258 A * 2/1980 Arai ..... B29D 99/0053 277/554
4,208,060 A * 6/1980 St. Laurent, Jr. ..... F16J 15/52 277/504
4,238,992 A * 12/1980 Tuck, Jr. ..... F04B 43/0054 92/103 SD
4,244,589 A * 1/1981 St. Laurent, Jr. ..... F16J 15/52 277/634
4,253,675 A * 3/1981 St. Laurent, Jr. ..... F16J 15/52 277/504
4,407,517 A * 10/1983 Neyer ..... H01F 7/1607 277/634
4,456,269 A * 6/1984 Krude ..... F16J 3/043 277/636
4,630,567 A * 12/1986 Bambousek ..... B05B 13/0431 118/323
4,785,760 A 11/1988 Tholome
4,830,882 A * 5/1989 Ichinose ..... B05B 15/0258 118/300
5,297,996 A * 3/1994 Draga ..... F16D 3/845 277/636
5,772,125 A * 6/1998 Ehinger ..... B05B 5/1625 118/302
6,070,622 A * 6/2000 Rutter ..... B65B 39/004 141/10
6,138,550 A * 10/2000 Fingar, Jr. ..... F04B 43/0054 92/103 R
6,145,430 A * 11/2000 Able ..... F04B 43/0063 92/100
6,230,609 B1 * 5/2001 Bender ..... F04B 43/0054 92/103 R
6,328,277 B1 * 12/2001 Hanada ..... F16K 7/17 251/325
6,391,392 B1 5/2002 Thome et al.
6,702,893 B2 3/2004 Thome et al.
6,712,285 B2 * 3/2004 Provenaz ..... B05B 12/1454 238/305
6,746,637 B1 * 6/2004 Huss ..... B29C 45/16 264/135
6,896,010 B2 * 5/2005 Cebola ..... B05B 12/1463 118/313
6,989,176 B2 1/2006 Congard et al.
7,677,130 B2 * 3/2010 Hezel ..... B25J 19/0029 74/490.06
8,025,026 B2 9/2011 Le Strat et al.
8,584,712 B2 11/2013 Ballu et al.
2002/0046699 A1 4/2002 Congard et al.
2002/0124799 A1 9/2002 Thome et al.
2002/0158149 A1 10/2002 Thome et al.
2005/0285350 A1 * 12/2005 Oricchio, Jr. ..... F16J 15/3296 277/549
2008/0230003 A1 9/2008 Le Strat et al.
2011/0259431 A1 10/2011 Ballu et al.

FOREIGN PATENT DOCUMENTS

EP 1326716 7/2003
FR 2890876 3/2007
WO 20101067015 6/2010

* cited by examiner

CLEANING-FILLING STATION FOR MEANS FOR SPRAYING A COATING PRODUCT

FIELD OF THE INVENTION

The invention relates to a cleaning and/or filling station for means for spraying a coating product mounted on a moving arm of a robot.

The term "coating product" is intended to refer to any product meant to be sprayed onto an object to be coated, such as a primer, a paint or varnish.

DESCRIPTION OF RELATED ART

It is known from EP-A-0274322 to equip the mobile end of the arm of a multi-axis robot with a sprayer combined with a reservoir containing a coating product to be sprayed. A station is used to replenish reservoir with the coating product. This station includes means for connecting the reservoirs with different circuits in each of which a coating product flows. After a phase of spraying of one or more objects to be coated, the robot proceeds to place the sprayer in an area close to the connecting means, in order to replenish the sprayer and its reservoir with coating product after it has possibly been cleaned, in case of changing the product. The time taken for cleaning and/or filling in such a unit is relatively long.

It is also known from EP-A-1326716 to arrange for circulation of a primary reservoir in the vicinity of a multi-axis robots equipped with sprayers associated with secondary reservoirs. When it becomes necessary to refill a secondary reservoir with a coating product, the robot is oriented towards the main reservoir and an associated cleaning station.

Moreover, WO-A-2010/067015 teaches the use of an accumulator within a filling station, which enables the rapid filling of the reservoir associated with a sprayer, in particular for the so called "main" colours.

In some known equipment units, the connection means comprise a head that is movable between a retracted position, where it does not interfere with the set up of a sub-assembly comprising of a sprayer and a reservoir within a docking unit, and an active position, allowing the transfer of cleaning product and/or coating product to that sub assembly. This connecting head is generally actuated by a rod which passes through a wall of the cabin, with the interposition of a sealing gasket. Indeed, the systems for driving, control and supply-feed are not necessarily suitable for operation in potentially explosive or hazardous environments. They have to be isolated from the interior volume of the cabin in which the spraying takes place. The above sealing gasket has a tendency to wear out to the point that it is no longer fully effective after a period of use of a few hundreds or thousands of hours. In addition, in the event of cleaning of the cabin from the inside, the products used can chemically attack the sealing gasket whose functional life is all the more shortened.

SUMMARY OF THE INVENTION

It is more specifically these drawbacks that the invention aims to remedy by offering a new station for cleaning and/or filling which comprises mobile connection means and with which the risk of leakage is significantly reduced.

To this end, the invention relates to a cleaning and/or filling station of a subassembly for spraying a coating product mounted on a moving arm of a robot, this station comprising a receiving zone for receiving at least one sprayer belonging to the spraying subassembly, and connection means between at least one feed circuit and the sprayer in place in the receiving zone. These connection means comprise at least one part that can be moved, in particular in translation, between a retracted position, at a distance from the sprayer in place in the receiving zone, and an active position, where the connection means enable the sprayer to be fed with cleaning product and/or coating product. In accordance with the invention, the station comprises a flexible membrane firmly attached, on the one hand, to the moveable part of the connection means and, on the other hand, to a fixed envelope for protecting a portion of the connection means, while this membrane is deformable and suitable for following the displacements of the moveable part between the retracted and active positions thereof.

Thanks to the invention, the membrane makes it possible to isolate the interior volume of the cabin, in which the coating product is dispersed in the form of a cloud of droplets, relative to the internal volume of the station which includes the apparatus for feeding and control of the connection means, which must be protected from splashes of the coating product and isolated from the explosive atmosphere of the cabin. The use of the membrane permits efficient isolation, without the need for passing through partitions with means such as a rod and a seal that can wear out.

According to advantageous but non essential aspects of the invention, such a station may incorporate one or more of the following features, taken in any technically feasible combination:

The flexible membrane has an annular shape, with an inner edge connected in a sealed manner with the movable part of the connection means and an outer edge connected in a sealed manner with the fixed casing envelope.

The flexible membrane is free of folds or bellow pleats.

The flexible membrane is made out of a material that is resistant to solvents and/or to cleaning products used in the station. In particular, the membrane may be made out of polytetrafluoroethylene.

The membrane is removable and closes off in a sealed manner an opening provided in the fixed casing envelope.

The connection means comprise a carriage that is moveable within a volume of the station which is isolated from the exterior by the protective casing envelope and this carriage supports a connection head of which at least one portion is located outside the isolated volume and a block for changing the coating product that enables feeding the connection head with a coating product selected from among a number of coating products.

An intermediate reservoir fed by the coating product changing block feeds, by way of the fluid connection means, the connection head with the selected coating product.

A first actuator moves the carriage in relation to a frame of the station, in a direction parallel to a direction of translation of the moveable part of the connection means, while the carriage supports a first actuator for moving of piston internal to the intermediate reservoir.

The carriage and the means for guiding the carriage in translation are mounted on a sliding tray moveable, relative to the frame of the station, between a working position where the moveable part of the connection means can reach its operative position, and a maintenance position, where the carriage and the elements that it supports are accessible from one side of the station opposite to the docking unit.

When the sliding tray is in the maintenance position, the flexible membrane is detached from the fixed casing envelope and lets remain an opening that connects an interior volume of the station and the exterior, on the side of the docking unit, while the station comprises the means for selectively closing this opening, that are independent of the membrane.

A casing for the station defines a first volume, containing components for supplying the connection means and a rear portion of the connection means, this first volume being designed to be installed in the cabin, out of the cabin or in an intermediate configuration in a coating installation, a second volume, containing an intermediate portion of the connection means, this second volume being designed to be installed, as chosen, in the cabin, out of the cabin or in an intermediate configuration in a coating installation, and a third volume, comprising at least the receiving zone and designed to be installed in the cabin in a coating installation.

By way of a variant, a casing for the station defines a first volume, containing components for supplying the connection means and a rear portion of the connection means, this first volume being designed to be installed in the cabin, out of the cabin or in an intermediate configuration in a coating installation, a second volume, containing an intermediate portion of the connection means, this second volume being designed to be installed, as chosen, either in the cabin, or just within the cabin confines, with a wall oriented in the direction towards the cabin in front of which the receiving zone is provided.

BRIEF DESCRIPTION OF THE DRAWINGS

The invention will be better understood and other advantages thereof will become more clearly apparent in light of the description following here below of a cleaning-filling station, of a spraying subassembly in accordance with its principles, provided solely by way of example and with reference made to the accompanying drawings in which.

DETAILED DESCRIPTION OF PREFERRED EMBODIMENTS OF THE INVENTION

Figure 1:
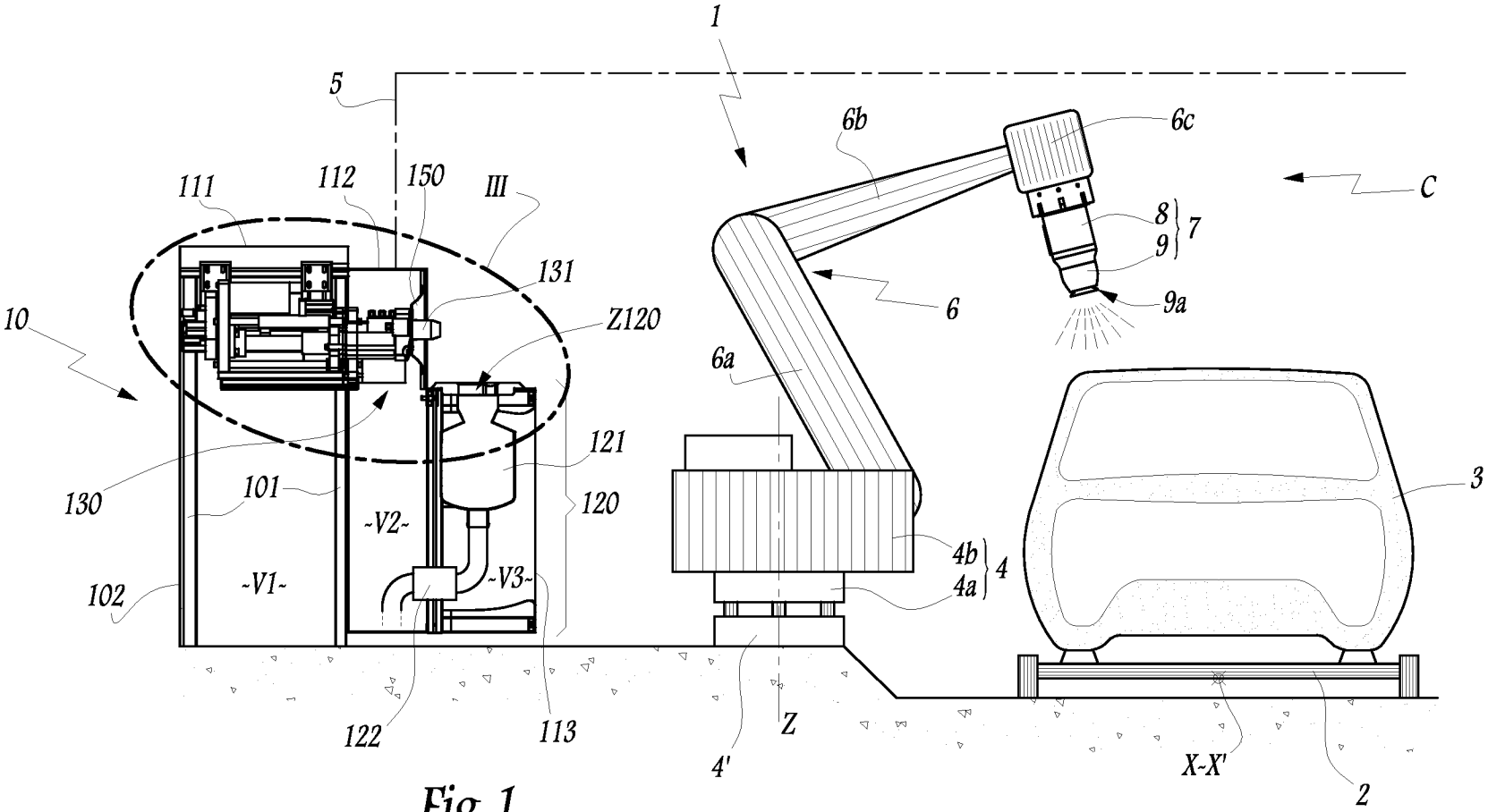
FIG. 1 is a schematic representation in principle, in the course of operation, of an installation for spraying coating product, incorporating a station in accordance with the invention.

In FIG. 1, an automaton or robot 1 is disposed in the proximity of a conveyor transporting objects 2 to be coated, in this case, bodies 3 for motor vehicles. The robot 1 is of the multi-axis type and includes a chassis 4 that is moveable on a guide 4' that extends in a direction parallel to the direction of conveyance X-X'. A wall 5 of a cabin C extends close to the robot 1, in a direction parallel to the direction X-X'.

An arm 6 of the robot 1 is supported by the chassis 4 and comprises a plurality of segments 6*a*, 6*b* and 6*c* articulated relative to each other. The chassis 4 is also comprised of parts 4*a* and 4*b* articulated relative to each other about an axis Z that is substantially vertical.

The segment 6*c* of the arms 6 supports a sub assembly 7 in which a reservoir 8 for the coating product and a sprayer 9 are provided. The sprayer 9 is of the electrostatic and rotary type and carries a bowl 9*a* designed to be driven at high speed by an air turbine provided in the body of the sprayer 9.

When a motor vehicle body 3 is in place at the level of the robot 1, the sub assembly 7 is displaced to be opposite this auto body and the sprayer 9 is activated, as shown in FIG. 1, in order to coat this auto body with the product contained in the reservoir 8. The quantity of product present in the reservoir 8 is appropriate relative to the surface area to be coated for an auto body 3.

Upon completion of the coating of an auto body, and while another auto body is being advanced towards the robot 1, along the direction of conveyance X-X', the robot 1 is oriented towards a cleaning-filling station 10 of the sub assembly 7. This station 10 is located in the vicinity of the robot 1, partially in the interior of the cabin C and partially outside thereof.

Figure 2:
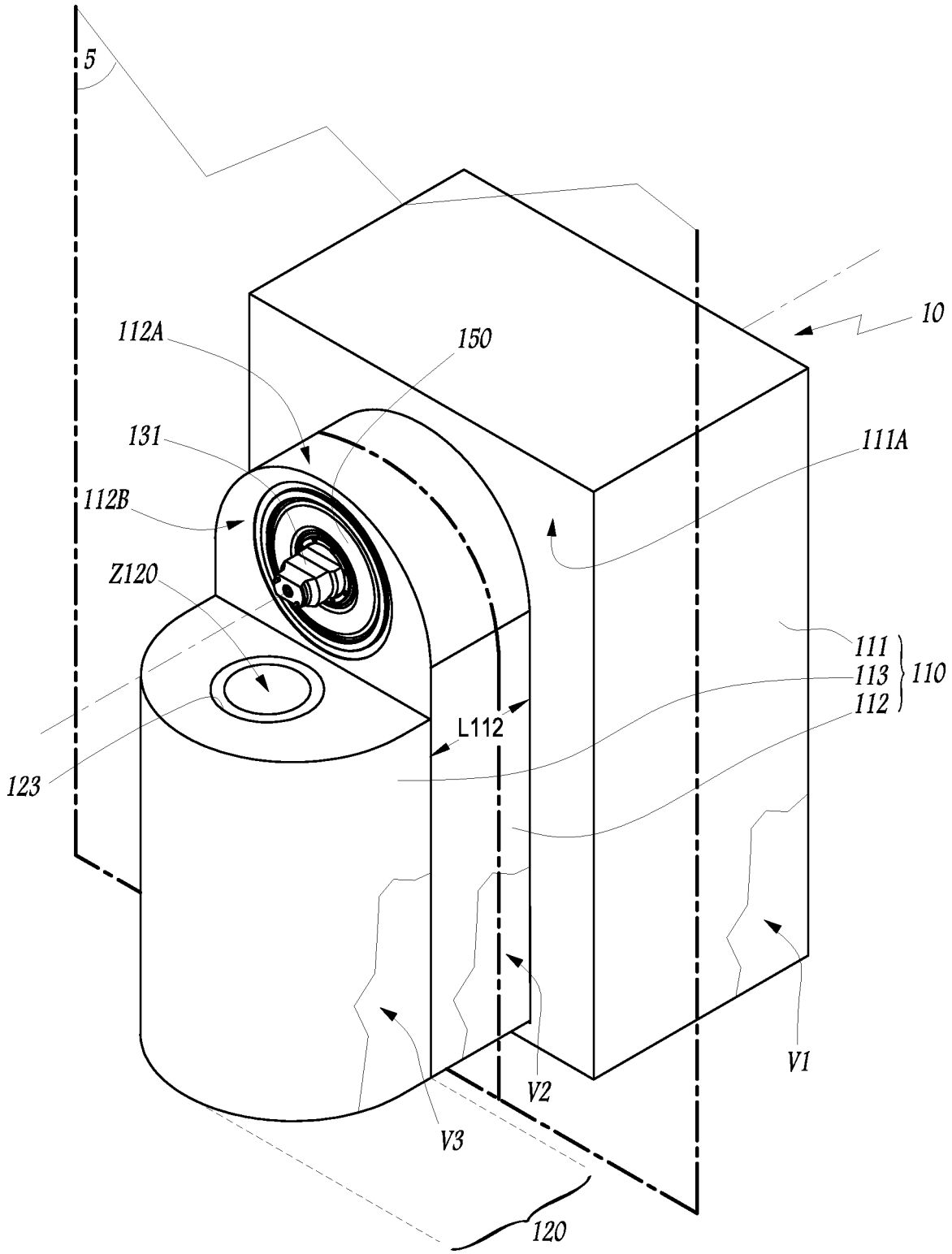
FIG. 2 is a perspective view, on a larger scale, and with partial tear away views, of a station of the installation shown in FIG. 1.

As shown more clearly in FIG. 2 and subsequent figures, the station 10 includes a frame 101 made of a mechanically fitted-welded structure and which defines three distinctly separate volumes V1, V2 and V3. The volume V1 is defined by a parallelepiped casing envelope 111 and it is closed, on the side opposite the cabin C, by a door 102 mounted in hinged manner on to the frame 101. The volume V2 is defined by a second casing envelope 112 which is parallelepiped in form in the lower part and comprises a top part 112A of rounded form. The volume V3 is defined by a third casing envelope which is in cylindrical section with vertical rectilinear generatrix.

The casing envelope 112 is arranged to bear against the casing envelope 111 and the volumes V1 and V2 communicate by means of that portion of the front face 111A of the casing envelope 111 which is masked by the casing envelope 112 shown in FIG. 2. In a similar fashion, the casing envelope 113 is pressed tight against the casing envelope 112 and the volumes V2 and V3 communicate by means of the portion of the front face 112B of the casing envelope 112 which is not covered by the casing envelope 113. This capability for communication is represented by the communication arrows C12 and C23 in FIG. 3.

The casing envelopes 111, 112 and 113 constitute together an external casing 110 for the station 10.

The station 10 defines a docking unit 120 which is designed for receiving the sub assembly 7 when it is necessary to clean and/or fill it with the coating product. In order to do this, the unit 120 defines a zone Z120 in which the sub assembly 7 can be partially engaged in a cleaning and/or filling configuration in the unit 120. The zone Z120 is defined in the volume V3, that is to say in the part of the station 10 which is surrounded by the casing envelope 113. This zone Z120 communicates with a rinsing box 121 sometimes referred to as "recovery unit" or "collector" which is connected to a separator 122 provided for separating the air from the liquids spilled by the sub assembly 7 of a robot 1 in the interior of the rinsing box 121. The separator 122 is connected, by hoses not shown, to a circuit for collecting contaminated air and a circuit for discharging the liquids sprayed towards a drain.

The unit 120 also comprises a ring 123 for locking of the sub assembly 7 of a robot 1 in an engaged configuration in the zone 120.

A connection head 131 is provided in order to manoeuvre the sub assembly 7 alongside a robot 1 into place in the zone Z120. This connection head is moveable in translation along an axis Y that is perpendicular to the direction X-X' and to the axis Z, as well as to the partition wall 5.

The head 131 is part of the connection means 130 which also includes a carriage 132 on which is mounted the head 131 and which is also moveable along the axis Y. This carriage supports an accumulator reservoir 133 whose outlet is connected, via a conduit 134 represented by its line of axis, to the connection head 131, through a plate 132A that forms part of the carriage 132. The reservoir 133 is supplied from a coating product changing block 135, which is itself supplied by flexible hoses 136 represented by their axis lines in FIGS. 3 and 5 and which are each connected to a distribution valve not shown which is disposed in the lower part of the volume V1. The block 135 is close to the reservoir 133. It is thus possible to successively supply the reservoir 133 and the head 131 with a preselected liquid coating product corresponding to one of those supplying the valves arranged in the volume V1. One of the hoses 136 is connected to a valve supplied with cleaning liquid appropriate for the various different coating products that are supposed to pass through the reservoir 133, the connection head 131 and the hoses that connect them.

The reservoir 133 is not mandatory. It is possible to feed the head 131 directly from the coating product changing block 135.

An electric motor 137 is mounted on the carriage 132 and it controls the movement of a piston 138 engaged in the reservoir 133, along a direction Y1-Y'1 parallel to the axis Y. The motor 137 provides the ability to push a coating product present in the reservoir 133 right into the connection head 131 and through the hose 134, when this is necessary.

A pneumatic cylinder 139 is mounted on the frame 101 and engages a rigid part of the carriage 132, which thereby enables the control of the movement of the carriage 132 and the elements that it supports in a direction parallel to the Y axis, as represented by the double arrow F1 shown in the figures. The connection head 131 is engaged in an opening with circular section 112C formed in the front face 112B of the casing envelope 112. Depending on the movement of the carriage 132 under the action of the cylinder 139, the head 131 projects more or less beyond the front face 112B, as this becomes apparent from a comparison of FIGS. 3 and 4, on the one hand, with FIGS. 5 and 6, on the other hand.

A flexible membrane 150 closes off the opening 112C, which prevents the pollution of volume V2, and through it, of the volume V1 and V3, through the opening 112C.

Figure 3:
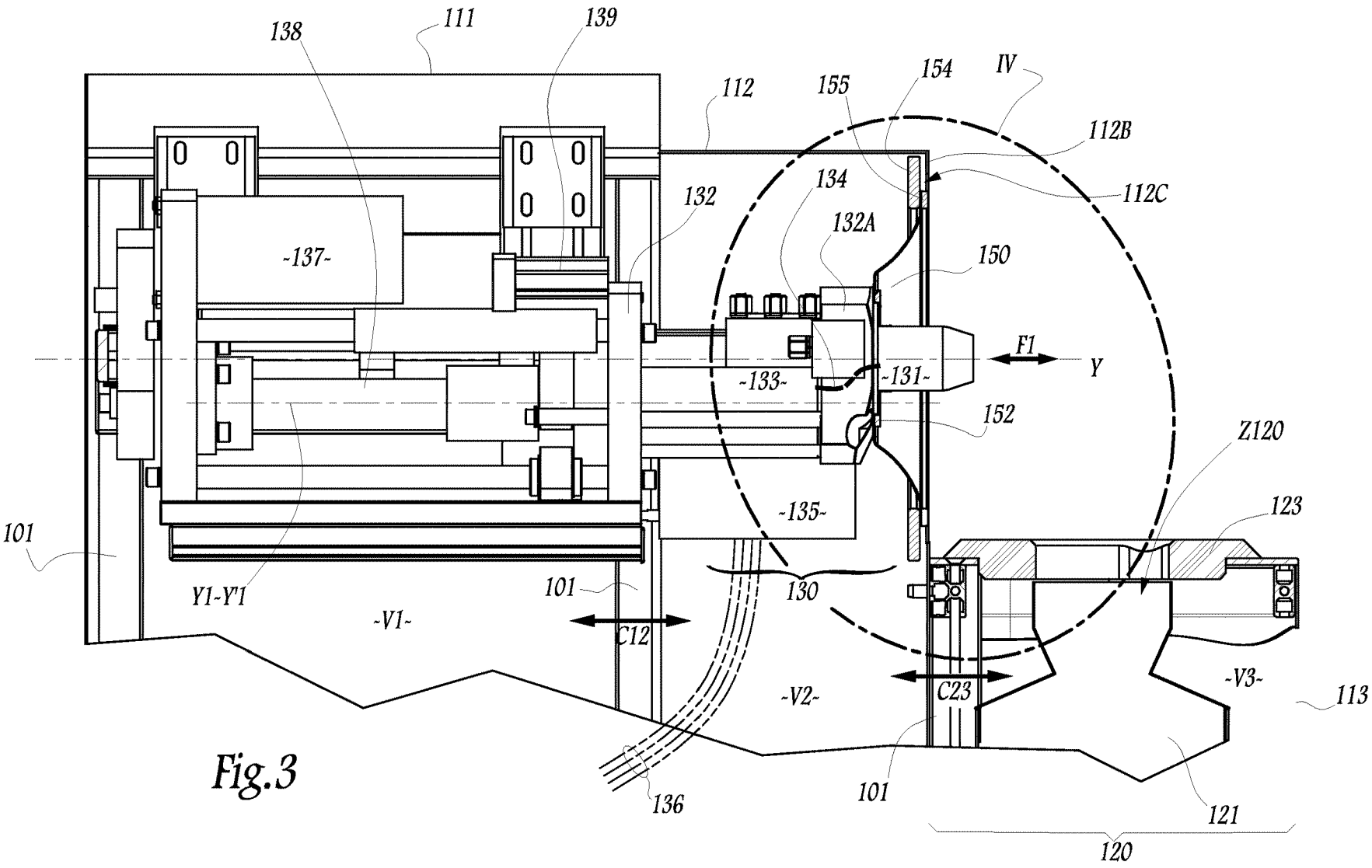
FIG. 3 is a view on a larger scale of the detail III shown in FIG. 1.
Figure 4:
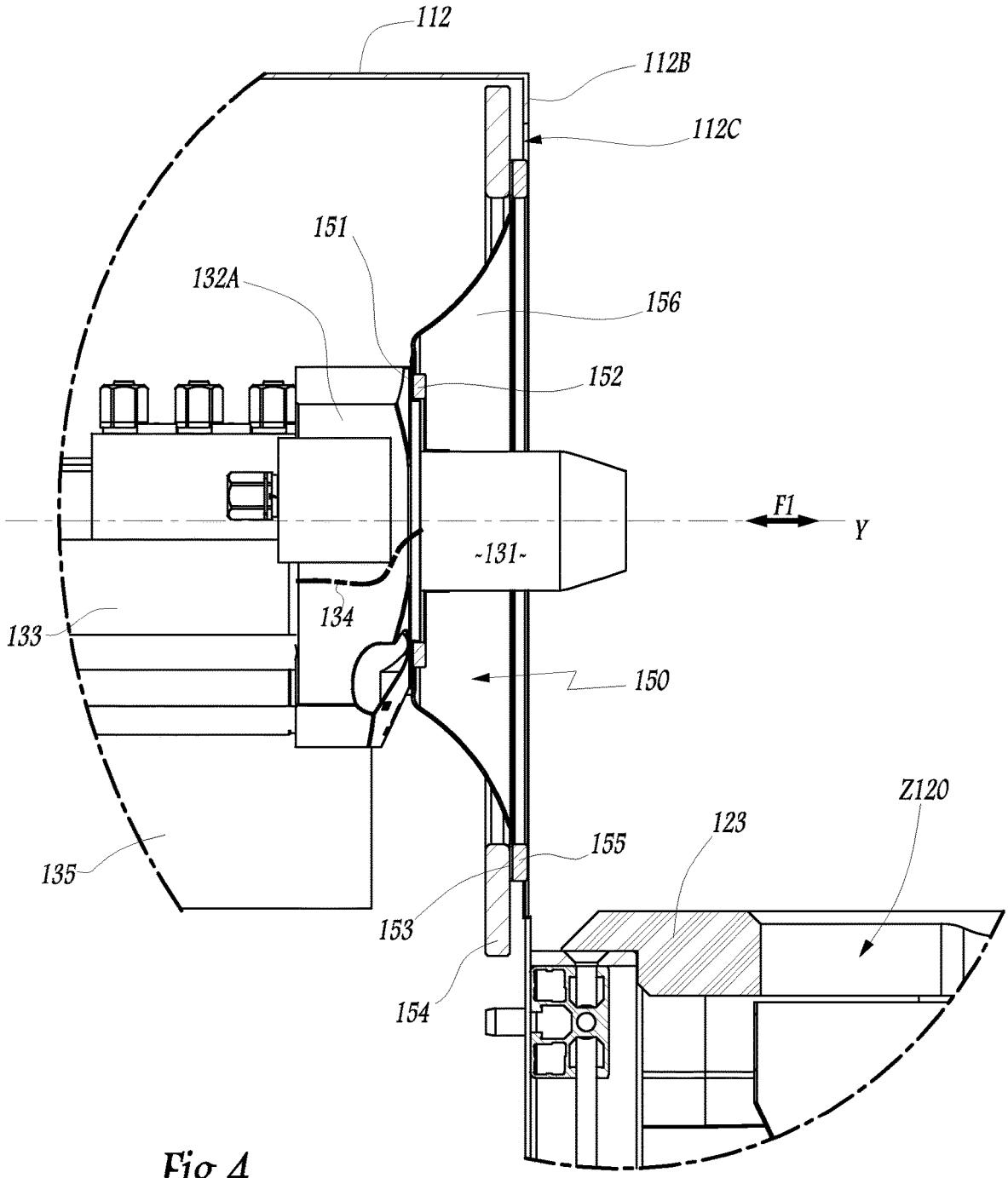
FIG. 4 is a view on a larger scale of the detail IV shown in FIG. 3.
Figure 5:
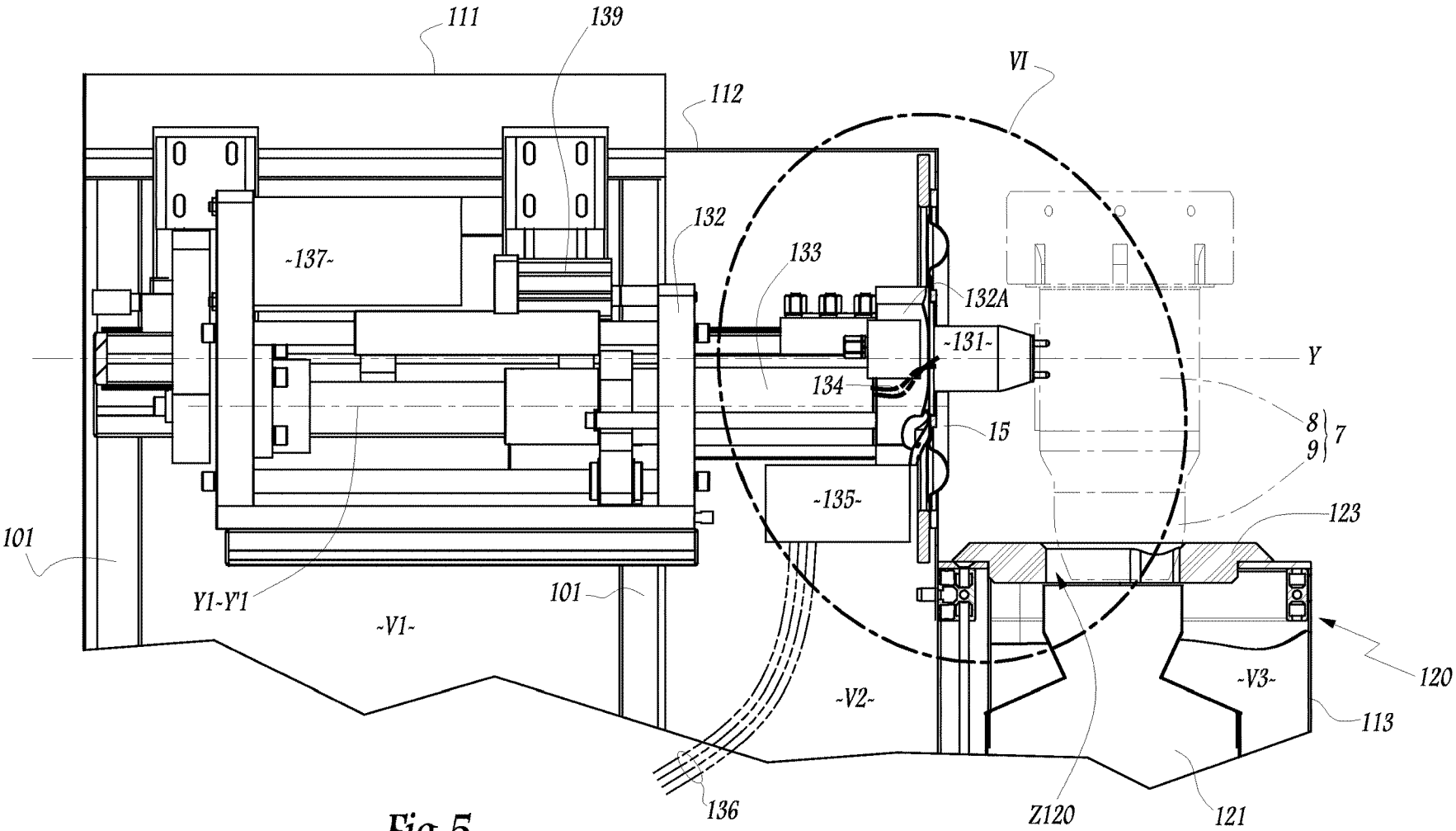
FIG. 5 is a view comparable to that in FIG. 3 when the installation is in another operating configuration.
Figure 6:
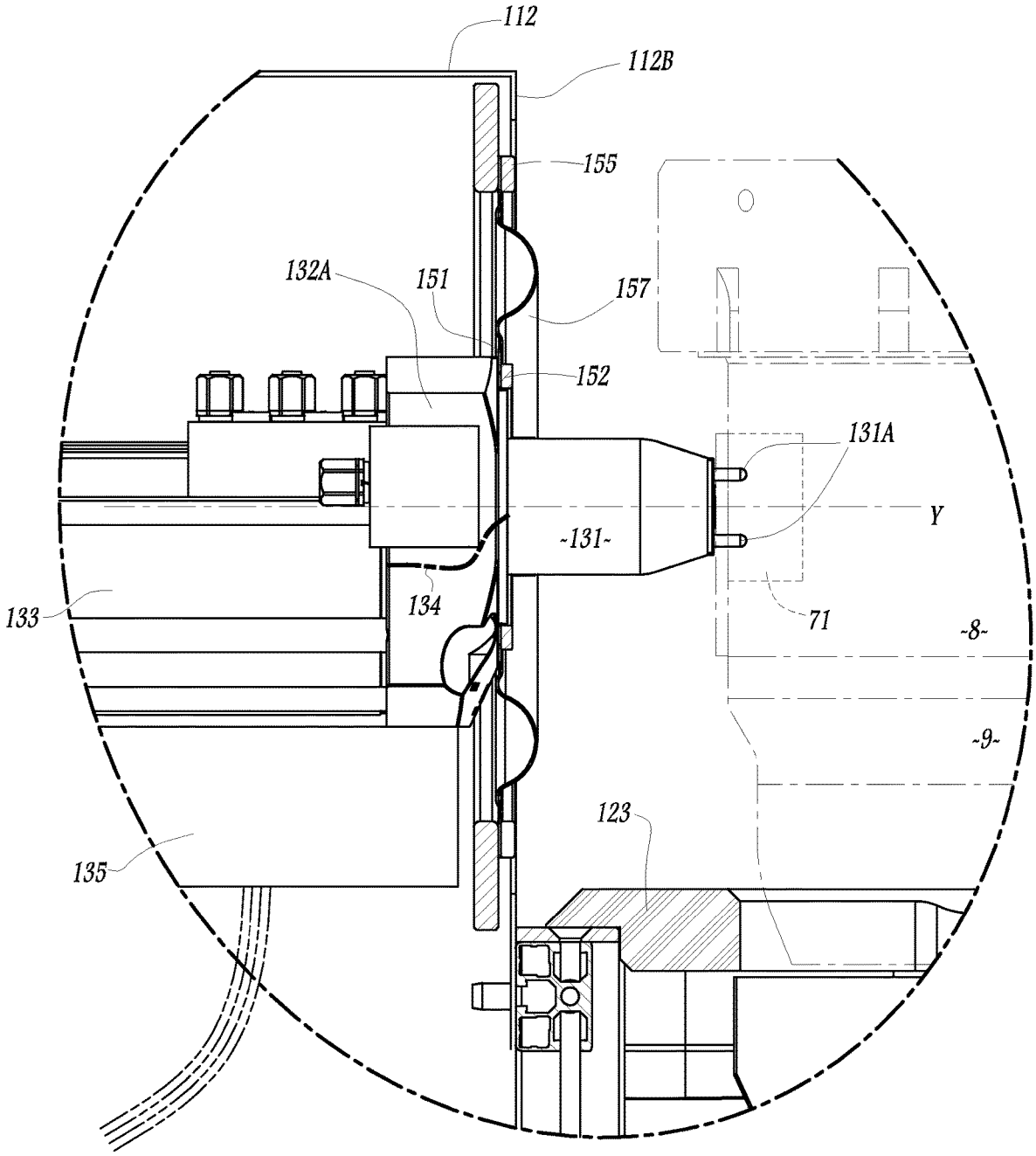
FIG. 6 is a view on a larger scale of the detail VI shown in FIG. 5.

The membrane 150 is annular in shape, adapted to the geometry of the carriage 132 and of the opening 112C and to the stroke of the connection head between its positions shown in FIGS. 3 and 4, on the one hand, and FIGS. 5 and 6, on the other hand. More precisely, the membrane 150 has a first edge 151, which forms an inner radial edge relative to the axis Y and which is secured in a sealed manner by a ring 152 on the plate 132A. The edge 151 and is thus integrally secured in translation and connected in a sealed manner to the head 131. The membrane 150 also has a second edge 153, which constitutes an outer radial edge relative to the axis Y and which is secured in a sealed manner to the periphery of the opening 112C by being tightly clamped between the two rings 154 and 155 themselves, immobilised on the front face 112B by any suitable means, such as in particular screws. The edge 153 is thus integrally secured in translation and connected in a sealed manner to the casing envelope 112.

In the configuration shown in FIGS. 3 and 4, the intermediate portion 156 of the membrane 150, between the edges 151 and 153, is slightly curved with its concavity turned to face the interior of the cabin C, so that it forms a single wave 157 in the configuration shown in FIGS. 5 and 6. By way of a variant, the membrane can form multiple waves in the second configuration. This intermediate portion is free of folds or bellow pleats, in a manner such that it does not create zones that are bent pleated or folded in which there could be an accumulation of the coating products or the cleaning product when the station 10 is being subjected to a cleaning operation by spraying of cleaning product from the interior of the cabin C. Within the meaning of the invention, a fold is a deformation of the membrane 50 which would have a radius of curvature that is less than ten times the thickness of this membrane. A bellow pleat is formed by a plurality of pleats or by juxtaposed fluting.

The membrane 150 is made out of polytetrafluoroethylene, which is a material that is resistant to the products commonly used in an installation for spraying coating products and to the temperature cycles encountered in such an installation. By way of a variant, other synthetic materials that are resistant to solvents and cleaning products used in the station 10 may be used to produce the membrane 150.

By way of a variant, the membrane may be made out of a natural material, for example rubber.

The operation of the station 10 is as follows:

When the robot 1 is oriented in the direction of the auto bodies 3, while the sprayer 9 is in operation, the station 10 is in the configuration shown in FIGS. 3 and 4. In this configuration, the connection head 131 is retracted towards the volume V2, in a position where it is disengaged from the zone Z120.

From the configuration shown in FIG. 1, when the sub assembly 7 of the robot 1 must be cleaned and supplied with a suitable quantity of coating product, the robot 1 rotates around the axis Z in order to bring its sprayer 9 into the zone Z120 of the docking unit 120, in a configuration corresponding to that shown schematically in uneven dashed lines in FIGS. 5 and 6 where the rest of the robot 1 is not represented for the sake of clarity of the drawing. In this configuration, the ring 123 is turned so as to lock the sub assembly 7 into position and the sprayer 9 can be activated in order to discharge into the box 121 the remaining quantity of the coating product.

It is then possible to move the carriage 2 from the configuration shown in FIGS. 3 and 4 to that shown in FIGS. 5 and 6, bringing the head 131 into contact with an assembly of valves 71 provided in the sub assembly 7 for collaborating in a sealed manner with the head 131. This movement is achieved by means of the cylinder 139. During this movement, the reservoir 133 and the block 135 are moved with the rest of the carriage 132. The motor 137 is then actuated so as to push the piston 138 in the direction of the sub assembly 7, which has the effect of allowing the transfer, into the reservoir 8 and through the conduit 134 and the head 131, of the contents of the reservoir 133 or of the selected colour.

In the position shown in FIGS. 5 and 6, guide pins 131A provided on the head 131 are pushed towards the assembly 71 in order to enable a relative centering of the components 131 and 71.

Before or after such operations, a cleaning product may be injected into the sub assembly 7 and/or into the conduit 134 connecting the reservoir 133 to the head 131 from the block 135, itself fed by one of hoses 136.

Upon completion of these operations, the cylinder 139 moves away the head 131 from the sub assembly 7. It is then possible to release the sub assembly 7 by unlocking the ring 123 and by causing the head 131 to retreat in the opposite direction from the sub assembly 7, thanks to a new action of the cylinder 139.

During the movements forward and backward of the head 131 and of the carriage 132 along the axis Y and relative to the sub assembly 7, the membrane 150 follows the movements of the plate 132A by deforming elastically, which is possible on account of its flexible nature.

As the block 135 is directly mounted on the carriage 132, in the proximity of the reservoir 133 and the head 131, the quantities of coating product lost during the changing of the product are minimal, since they depend on the length of the hoses between the elements 133 and 135.

The mounting of the membrane 150 on the casing envelope 112 is reversible. Thus, when it is appropriate to carry out maintenance operations, it is possible to detach the membrane 150 from the casing envelope 112 in order to access the volumes V1, V2 and V3 of the station 10. More specifically, the ring 154, which remains integrally secured to the edge 153 is detached from the front face 112B.

Figure 7:
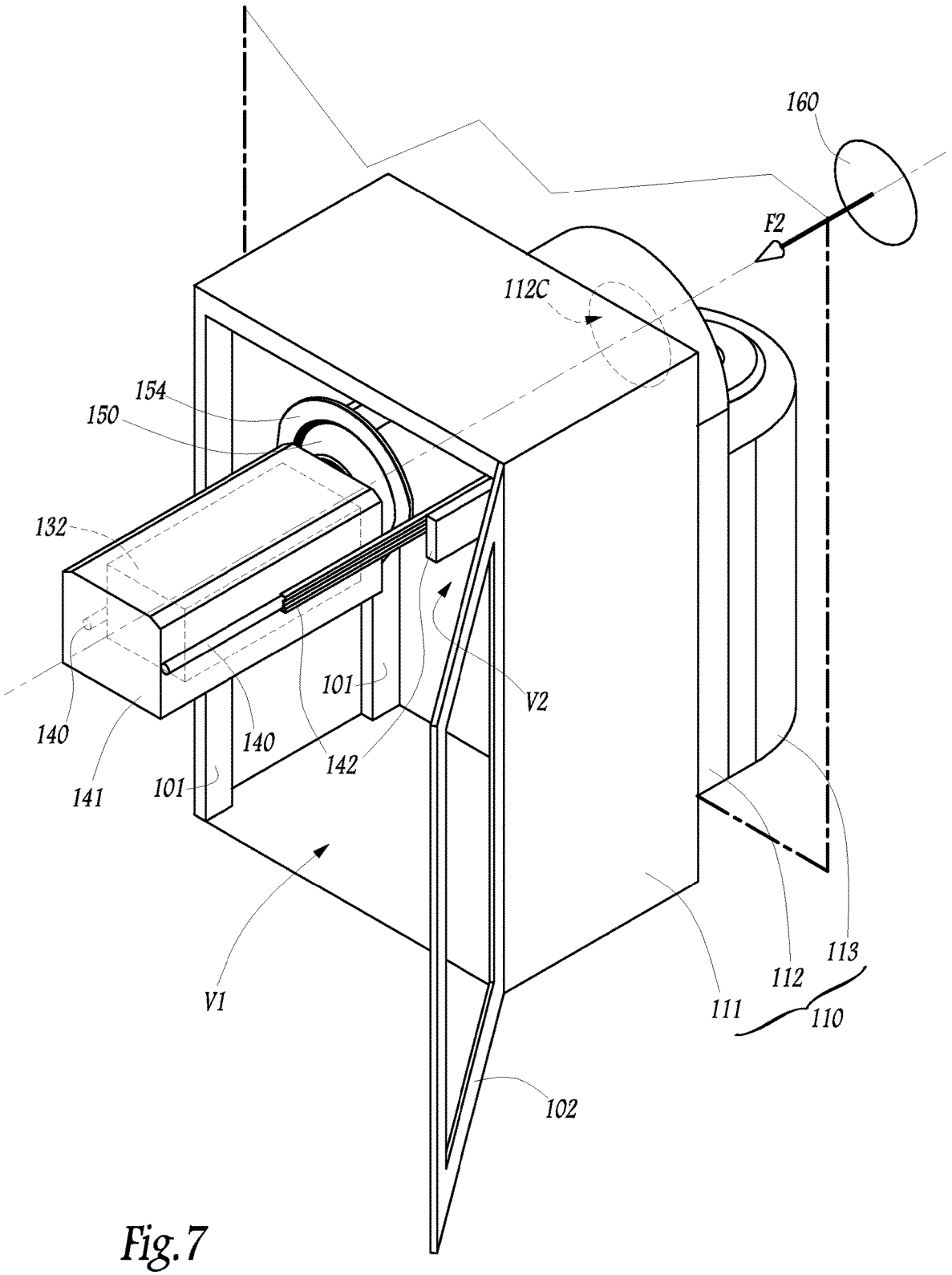
FIG. 7 is a perspective view, from a side opposite to that shown in FIG. 2, of the cleaning and/or filling station in a maintenance configuration.

As it becomes apparent more particularly from FIG. 7, the carriage 132 which is represented in this figure in a very schematic fashion, is supported by the guide rails 140 which guide it along the axis Y. These rails are themselves supported by a sliding tray 141 moveable in a direction parallel to the axis Y by means of telescopic rails 142.

During an operation of maintenance and as shown in FIG. 7, it is possible, after having detached the outer edge 153 from the membrane 150 relative to the casing envelope 112 to cause the retreating of the sliding tray 141, the carriage 132 and the elements that it supports away from the front face 112B of the casing envelope 112 in order to easily access the carriage 132 and the other parts of the connection means 130.

In this configuration, the opening 112C is wide open. In order to allow the use of cabin C during such a maintenance operation, a removable plug 160 is provided in the station 10 meant to be temporarily mounted over the opening 112C in order to the close it off and isolate the volumes V1, V2 and V3 from the interior volume of the cabin C.

The station is installed through the wall 5 of the cabin C. The position of the frame 101 relative to the partition wall 5 may be chosen by the designer of the cabin C, based on the dimensional or space requirements thereof and the movement clearance of the robot 1. It is sufficient for the zone 120 and the head 131 to be in the zone reachable by the sub assembly 7. The casing envelope 112 may be more or less engaged into the interior volume of the cabin C. In other words, the length L112 of the casing envelope 112 measured in the direction parallel to the axis Y is a variable for adjusting the position of the station 10 relative to the cabin C.

Thus, the track of the partition wall 5 on the casing envelope 112 may be moved between the front faces 111A and 112B, at the choice of the designer of the installation.

The invention allows for the possibility of the elements arranged in one of the volumes V1, V2 and V3 not being explosion proof, whereas that should have been the requirement in the case of their being incorporated directly into the interior volume of the cabin C, or in a volume in communication with the cabin.

The invention is described here below for a cleaning and filling station. The invention is applicable to a station in which the operation to be carried out is that of only cleaning or only filling of a spraying sub assembly.

The invention is illustrated in the figures with a circular membrane 150. However, it is applicable to other membrane geometries. In practice, the membrane is adapted to the geometry of the plate 132A and the opening 112C.

According to one variant of the invention which is not represented, the zone Z120 for receiving the sprayer 9 can be defined along the front face 112B of the casing envelope 112, without providing for a docking unit such as the unit 120. In this case, the front face 112B of the casing envelope 112 extends over the entire height of the casing envelope and a collector for unused coating product and/or cleaning product is disposed in the vicinity of the floor of the cabin, in front of the station 10. In this case, the casing 110 does not include the casing envelopes 111 and 112 and the receiving zone Z120 is provided on the front of the casing envelope 112.

Maintenance personnel are able to easily access the zone Z120 for receiving the sprayer, in case this is necessary.

As in the first embodiment, the casing envelope 112 may be more or less engaged in the interior volume of the cabin C.

In the embodiment shown in the figures and in the variant here above, the volume V1 may, by way of a variant, be partially or completely located in the interior of the cabin C. When partially disposed within the volume of the cabin C, the volume V1 is in an intermediate configuration between an "in cabin" position and an "out of cabin" position. When the volume V1 is in this intermediate configuration, the track of the partition wall 5 on the casing 110 is at the level of the casing envelope 111, beyond the wall 111A relative to the volume V2.

The invention is illustrated in the figures in the case where the head 131 and the carriage 132 are moveable in translation along the axis Y. By way of a variant, these elements may be moveable in rotation, in particular by using a cam system, between the retracted position and the active position of the head.

The invention claimed is:

1. A station for cleaning and/or filling of a spraying subassembly for spraying coating product mounted on a moveable arm of a robot installed within a cabin, this station comprising:

a receiving zone for receiving at least one sprayer belonging to the spraying sub-assembly, connection means for connection between at least one feed circuit and the sprayer in place in the receiving zone, these connection means comprising at least one part that can be moved between a retracted position at a distance from the sprayer in place in the receiving zone, and an active position, wherein the connection means enable the sprayer to be fed with cleaning product and/or coating product, wherein the station comprises a flexible membrane which isolates an interior volume of the cabin, in which a coating product is dispersed in the form of a cloud of droplets, relative to an internal volume of the station which includes an apparatus for feeding and control of the connection means, the flexible membrane being firmly attached, on the one hand, to the moveable part of the connection means and, on the other hand, to a fixed casing envelope for protecting a portion of the connection means, and wherein said flexible membrane is deformable along a horizontal axis and suitable for following the displacements of the moveable part between the retracted and active positions thereof, and wherein the flexible membrane is free of folds and bellow pleats, wherein the flexible membrane has an intermediate portion, and wherein the flexible membrane, in active operation, is constructed and configured to take a first operational configuration where the intermediate portion is slightly curved, and a second operational configuration where the intermediate portion forms at least a wave; and wherein the connection means comprise a carriage that is moveable within an isolated volume of the station which is isolated from the exterior of the station by the fixed casing envelope and in this carriage supports a connection head of which at least one portion is located outside the isolated volume, a coating product changing block for feeding the connection head with a coating product.

2. A station according to claim 1, wherein the flexible membrane has an annular shape, with an inner edge connected in a sealed manner with the movable part of the connection means and an outer edge connected in a sealed manner with the fixed casing envelope.

3. A station according to claim 1, wherein the flexible membrane is made out of a material that is resistant to solvents and/or to cleaning products used in the station.

4. A station according to claim 1, wherein the flexible membrane is removable and closes off in a sealed manner an opening provided in the fixed casing envelope.

5. A station according to claim 1, wherein an intermediate reservoir fed by the coating product changing block feeds, by way of fluid connection means, the connection head with the coating product.

6. A station according to claim 5, wherein a first actuator moves the carriage in relation to a frame of the station, in a direction parallel to a direction of translation of the moveable part of the connection means, and wherein the carriage supports a second actuator for moving of a piston internal to the intermediate reservoir.

7. A station according to claim 1, wherein the carriage and means for guiding the carriage in translation are mounted on a sliding tray moveable, relative to a frame of the station, between a working position where the moveable part of the connection means can reach an operative position, and a maintenance position, where the carriage and elements that it supports are accessible from one side of the station opposite to a docking unit.

8. A station according to claim 7, wherein when the sliding tray is in the maintenance position, the flexible membrane is detached from the fixed casing envelope and lets remain an opening that connects an interior volume of the station and the exterior, on a side of the docking unit, and wherein the station comprises means for selectively closing this opening, that are independent of the flexible membrane.

9. A station according to claim 1, wherein a casing for the station defines a first volume containing components for supplying the connection means and a rear portion of the connection means, this first volume being designed to be installed in a cabin, out of the cabin or in an intermediate configuration in a coating installation, a second volume, containing an intermediate portion of the connection means, this second volume being designed to be installed either in the cabin, out of the cabin or in an intermediate configuration in the coating installation, and a third volume, comprising a docking unit defining at least the receiving zone, and this third volume being designed to be installed in the cabin in the coating installation.

10. A station according to claim 1, wherein a casing for the station defines a first volume containing components for supplying the connection means and a rear portion of the connection means, this first volume being designed to be installed in a cabin, out of the cabin or in an intermediate configuration in a coating installation, a second volume, containing an intermediate portion of the connection means, this second volume being designed to be installed either in the cabin, or just within the cabin confines, with a wall oriented in the direction towards the cabin in front of which the receiving zone is provided.

11. A station according to claim 3, wherein the flexible membrane is made out of polytetrafluoroethylene.

12. A station according to claim 1, wherein in the first configuration, the intermediate portion has its concavity turned to face an interior of the cabin.

* * * * *